US006013367A

United States Patent [19]

Nakagawa et al.

[11] Patent Number: 6,013,367

[45] **Date of Patent: *Jan. 11, 2000**

[54] CELLULOSE MULTIFILAMENT YARN AND WOVEN FABRICS PRODUCED THEREFROM

[75] Inventors: Masanori Nakagawa, Nagaokakyo; Akikazu Itani, Toyonaka, both of Japan

[73] Assignees: Asahi Kasei Kogyo Kabushiki Kaisha, Osaka, Japan; Akzo Nobel Faser AG, Wuppertal, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/029,663

[22] PCT Filed: Aug. 27, 1996

[86] PCT No.: PCT/JP96/02383

§ 371 Date: Feb. 27, 1998

§ 102(e) Date: Feb. 27, 1998

[87] PCT Pub. No.: WO97/08370

PCT Pub. Date: Mar. 6, 1997

[30] Foreign Application Priority Data

Aug. 29, 1995 [JP] Japan ..... 7-220499

[51] Int. Cl.[7] ..... D02G 3/00

[52] U.S. Cl. ..... 428/393; 8/194

[58] Field of Search ..... 8/194; 428/393, 428/364

[56] References Cited

U.S. PATENT DOCUMENTS

| | | | |
|---|---|---|---|
| 4,246,221 | 1/1981 | McCorsley | 264/203 |
| 4,416,696 | 11/1983 | McCorsley | 106/163 R |
| 5,779,737 | 7/1998 | Potter et al. | 8/194 |

FOREIGN PATENT DOCUMENTS

| | | |
|---|---|---|
| 0494851 A2 | 7/1992 | European Pat. Off. . |
| 60-28848 | 7/1985 | Japan . |
| 4-308219 | 10/1992 | Japan . |
| 06306733 | 11/1994 | Japan . |
| 07157968 | 6/1995 | Japan . |
| 07189019 | 7/1995 | Japan . |
| 95/24524 | 9/1995 | WIPO . |

OTHER PUBLICATIONS

European Search Report dated Aug. 12, 1999.

Lenz et al., "Properties and Structure of Lyocell and Viscose–Type Fibres in the Swollen State," Lenzinger Berichte (1994).

*Primary Examiner*—Newton Edwards

*Attorney, Agent, or Firm*—Finnegan, Henderson, Farabow, Garrett & Dunner, L.L.P.

[57] ABSTRACT

A cellulose multifilament yarn which is a lyocell multifilament yarn and has a breaking tenacity of 2.8–4.0 g/d and a breaking elongation of 13–20% both as dried and which gives a tenacity-elongation curve passing a tenacity range of 0.2–1.0 g/d at an elongation of 5% and a tenacity range of 0.4–2.5 g/d at an elongation of 10%.

6 Claims, 3 Drawing Sheets

CELLULOSE MULTIFILAMENT YARN AND WOVEN FABRICS PRODUCED THEREFROM

TECHNICAL FIELD

The present invention relates to a novel cellulose multifilament yarn and a fabric made thereof. More particularly, the present invention relates to a cellulose multifilament yarn having unique properties and a fabric made thereof.

BACKGROUND ART

Fabrics made of a regenerated cellulose fiber have had problems in that they have a tendency of creasing in grey and retaining the wrinkles generated in a wet condition (e.g. scouring), even after the drying step (a finishing step), giving a product fabric of very low quality.

In order for a product fabric not to generate wrinkles, measures are taken such as scouring and dyeing of fabric in rope form in bath containing softener, levelling agent or the like or scouring and dyeing of fabric in open width.

In order for a product fabric not to generate wrinkles during laundering, resin finish is applied to a fabric after dyeing. This treatment, however, have various problems; for example, the product fabric has a hard hand and a reduced strength.

A fabric which is being developed recently and which is made of a cellulose fiber obtained by spinning with an organic solvent, i.e. a lyocell fiber, generates wrinkles even after ordinary scouring in open width and gives heavy wrinkles after scouring in a rope form. These wrinkles generated in this fabric are not at all improved even when the fabric is dried under tension after the scouring. Thus, the conventional lyocell fiber has a large problem in practical application. JP-A-6-306733 discloses a process for producing a fibrillated fiber from an easily fibrillatable fiber, as an example of which a lyocell fiber is cited, by subjecting the latter fiber to a rubbing treatment in a solution containing a swelling agent for the fiber. The swelling agent includes an aqueous alkali solution (e.g. an aqueous sodium hydroxide solution). The rubbing treatment refers to rubbing a fabric in a rope form by the use of a machine such as washer (low-pressure type), continuous relaxing machine, jet dyeing machine, air flow dyeing machine, winch dyeing machine or the like. In such a treatment, reduction in fiber strength and generation of wrinkles are inevitable. JP-A-7-157968 discloses a rubbing treatment in an aqueous solution containing 60 g/l of sodium hydroxide by the use of a jet dyeing machine. This treatment is intended to rub a fabric in a rope form to form friction marks.

WO 95/24524 discloses mercerization of a fabric made of a lyocell fiber. In this mercerization, the fabric is treated in an aqueous solution containing a high concentration (10–30% by weight) of sodium hydroxide under tension. This mercerization is intended to improve the appearance of a lyocell fiber, particularly the condition of a fabric surface looking covered with frost due to friction mark. This mercerization, however, allows the resulting fabric to have a reduced tenacity and to invite generation of wrinkles after dyeing or during laundering.

The wrinkles generated in a fabric after dyeing or in a product fabric during laundering refers to the wrinkles generated in a fabric in a wet condition or in the transition period from a wet condition to a dry condition.

Generation of wrinkles is more frequent in viscose rayon than in cuprammonium rayon. However, when a tension is applied in open width in order to eliminate the wrinkles generated in a wet condition, in a drying step, the tension may be smaller in viscose rayon than in cuprammonium rayon. That is, viscose rayon generates wrinkles in a wet condition more easily but the wrinkles can be removed more easily. Conventional regenerated cellulose fibers typified by these viscose rayon and cuprammonium rayon have a low tenacity and a high elongation.

In contrast, in conventional lyocell fibers, the wrinkles are difficult to eliminate because the fibers have a poor balance between tenacity and elongation in a dry condition. In order to eliminate the wrinkles of a fabric made of a conventional lyocell fiber, it is considered effective to change the tenacity-elongation balance in a dry condition to a balance such as possessed by viscose rayon. However, in order to utilize the high tenacity possessed by a lyocell fiber, it is most desirable to change a lyocell fiber so as to have a high tenacity and a high elongation while reduction in tenacity is minimized.

DISCLOSURE OF INVENTION

The present inventors made a study in order to clarify the mechanism of wrinkle generation in the dyeing step of a fabric made of a lyocell fiber. As a result, the present inventors found out that the wrinkles generated in a fabric made of a lyocell multifilament yarn in a wet condition can be eliminated after drying, by controlling the balance between tenacity and elongation of the lyocell when dried. The present invention has been completed based on the above finding.

The present inventors also made a study on the balance between tenacity and elongation, of lyocell when dried. As a result, the present inventors found out that a lyocell multifilament yarn, which has been modified so as to have a breaking tenacity of 2.8–4.0 g/d [2.5–3.6 g/dtex (1 d=1.11 dtex)] and a breaking elongation of 13–20% both as dried and further so as to give a tenacity-elongation curve passing particular tenacity ranges at particular elongations, is less likely to generate wrinkles. The present invention has been completed based on the above finding.

The present invention provides a cellulose multifilament yarn which is a lyocell multifilament yarn and has a breaking strength of 2.8–4.0 g/d (2.5–3.6 g/dtex) and a breaking elongation of 13–20% both as dried and which gives a tenacity-elongation curve passing a tenacity range of 0.2–1.0 g/d (0.18–0.90 g/dtex) at an elongation of 5% and a tenacity range of 0.4–2.5 g/d (0.36–2.3 g/dtex) at an elongation of 10%; and a fabric comprising the yarn.

The object of the present invention is to provide a lyocell multifilament yarn capable of producing a fabric which generates substantially no wrinkles during the dyeing of the fabric or during the laundering of the product fabric; and a fabric made of the yarn.

BEST MODE FOR CARRYING OUT THE INVENTION

The cellulose multifilament yarn of the present invention is made of a lyocell fiber.

A lyocell fiber is a cellulose fiber obtained by organic solvent spinning, which is produced by dissolving cellulose in a mixed solvent consisting of water and an organic solvent capable of dissolving the cellulose and subjecting the resulting solution, as a spinning solution, to wet or dry spinning.

The cellulose multifilament yarn of the present invention has a breaking tenacity of 2.8–4.0 g/d (2.5–3.6 g/dtex) and a breaking elongation of 13–20% both as dried. In order to utilize the inherent high tenacity of lyocell fiber to endow a fabric made of the lyocell fiber, with excellent wrinkle recovery, the present cellulose multifilament yarn preferably has a breaking strength of 2.8–3.5 g/d (2.5–3.2 g/dtex) and a breaking elongation of 13–16.5% both as dried.

The present cellulose multifilament yarn gives a tenacity-elongation curve which passes particular ranges, when measured by a method described later.

Figure 1:
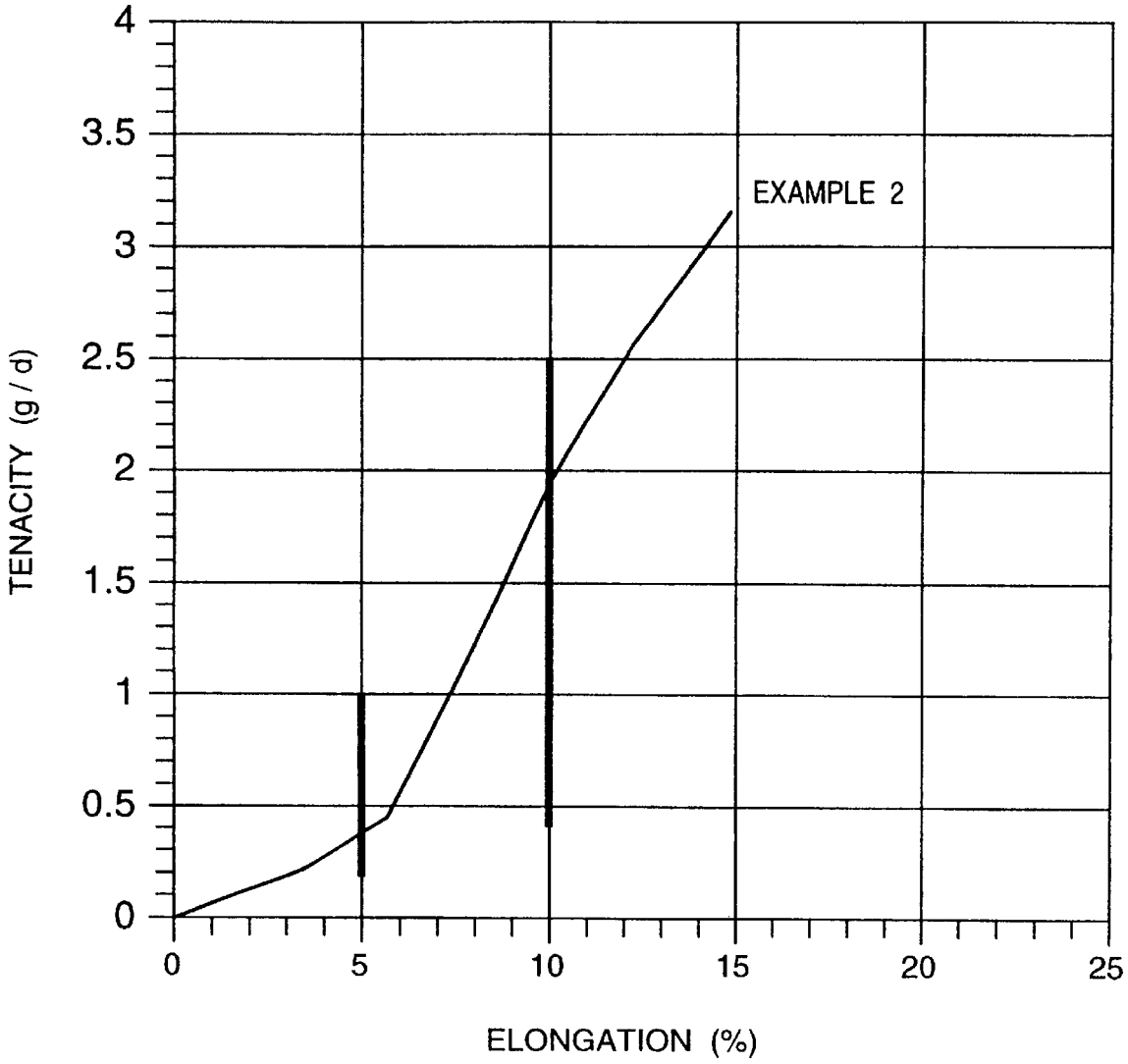
FIG. 1 is an example of the tenacity-elongation curve of the cellulose multifilament yarn of the present invention.

The particular ranges are specifically (i) a tenacity range of 0.2–1.0 g/d (0.18–0.90 g/dtex), preferably 0.3–0.8 g/d (0.27–0.72 g/dtex) at an elongation of 5% and (ii) a tenacity range of 0.4–2.5 g/d (0.36–2.3 g/dtex), preferably 1.0–2.5 g/d (0.90–2.3 g/dtex) at an elongation of 10%. In FIG. 1 is shown the tenacity-elongation curve of a cellulose multifilament yarn (Example 2 described later) of the present invention. It is preferable that the tenacity-elongation curve of the present yarn passes the above-mentioned ranges so that the curve can show a mild rising at the start and thereafter a relatively sharp rising up to the breakage of the yarn, resulting in a high breaking tenacity and a high breaking elongation. When the tenacity-elongation curve of the present cellulose multifilament yarn passes the above ranges, a fabric made of the present yarn become less liable to plastic deformation when subjected to deformation by bending stress or the like during laundering or dyeing treatment (scouring and dyeing) and, as a result, generates less wrinkles and can easily eliminate the generated wrinkles.

The cellulose multifilament yarn having a particular tenacity-elongation balance such as mentioned above has both an inherent high tenacity of lyocell fiber and excellent wrinkle recovery and is a novel cellulose yarn.

The cellulose multifilament yarn of the present invention preferably has a total denier of 20–300 d (22–333 dtex) and a single filament denier of 0.5–10 d (0.56–11 dtex).

Then, description is made on the process for production of the present invention.

A lyocell multifilament yarn can be produced by, as described in, for example, JP-B-60-28848, spinning a solution containing an organic solvent, a cellulose dissolved in the organic solvent, and a non-solvent (e.g. water), into air or other non-precipitating medium, pulling the fiber-formable solution emitted from a spinneret, at a speed larger than the feed speed to form a yarn at a draft ratio of 3 or more, and then treating the yarn in a non-solvent.

The organic solvent may be a known organic solvent, for example, one of the following amine oxides disclosed in JP-B-60-28848, or other organic solvent. Examples of the amine oxides are tertiary amine N-oxides such as trimethylamine N-oxide, triethylamine N-oxide, tripropylamine N-oxide, monomethyldiethylamine N-oxide, dimethylmonoethylamine N-oxide, monomethyldipropylamine N-oxide and the like; N-dimethyl-, N-diethyl- or N-dipropylcyclohexylamine N-oxide; pyridine N-oxide; cyclic mono(N-methylamine N-oxide)s such as N-methylmorpholine N-oxide and the like. Of these amine oxides, N-methylmorpholine N-oxide is preferred.

The above-obtained lyocell multifilament yarn has a breaking tenacity of 3.0–5.0 g/d (2.7–4.5 g/dtex) and a breaking elongation of 5–10% both as dried.

The above-obtained lyocell multifilament yarn and the fabric made thereof are treated with a particular swelling agent or a particular solvent both for the yarn. The swelling agent or the solvent is an alkali agent such as sodium hydroxide, potassium hydroxide, sodium carbonate, potassium carbonate, sodium silicate or the like; or an organic solvent such as N,N-dimethylformamide, N,N-dimethyl sulfoxide, N-methylmorpholine N-oxide or the like. Of these, an alkali agent such as sodium hydroxide, potassium hydroxide, sodium carbonate, potassium carbonate, sodium silicate is particularly preferred.

A preferable production process of the present invention is described below on a case of using an alkali agent as the swelling agent. The same conditions as used in this case are applicable also to other cases using other swelling agent or a solvent, unless the other swelling agent or the solvent has any particular problem. The alkali agent is used in the form of an aqueous alkali solution having an alkali concentration of 50 g/l to 150 g/l. When the alkali concentration is lower than 50 g/l, no sufficient wrinkle improvement is obtained; when the alkali concentration is higher than 150 g/l, good wrinkle improvement is obtained but the product obtained has no sufficient tenacity. The temperature of treatment with the alkali agent is preferably 5–60° C. When the temperature is lower than 5° C., reduction in tenacity is large; when the temperature is higher than 60° C., yellowing appears. The time of treatment with the alkali agent is preferably 20 seconds to 2 minutes. When the time is longer than 2 minutes, reduction in tenacity is large.

In the present production process, the tension applied to a yarn or fabric and the form of the yarn or fabric used when the yarn or fabric is treated with a swelling agent or a solvent, is very important. Below is explained a method for treating a fabric or yarn with an aqueous alkali solution.

(1) A method for treating a fabric with an aqueous alkali solution

Treatment of a fabric with an aqueous alkali solution and subsequent neutralization must be conducted in open width. The "open width" refers to a state in which a fabric is spread. A state such as rope form in which wrinkles are generated, is not called "open width". Treatment of a fabric in a rope form using a jet dyeing machine, an air flow dyeing machine or the like is not preferred because it generates wrinkles and invites dyeing wrinkles. When the fabric is in open width, any of a continuous treatment or a batchwise treatment is usable. When a continuous treatment is employed, a continuous scouring machine of open width type or the like can be used; when a batchwise treatment is employed, boiling in loop or the like can be used.

During the treatment, care must be taken so that no excessive tension is applied to a fabric to be treated. The tension applied to the fabric is preferably a force required for pulling the fabric by 0–1%, both in the warp direction and the weft direction of the fabric. Treatment of a fabric under tension is not preferable because it results in reduction in breaking elongation and no wrinkle improvement is obtained. Therefore, it is preferable to use, for the treatment of a fabric, a machine or method in which the tension applied to the fabric in the warp and weft directions can be minimized; for example, a continuous scouring machine [e.g. a Hinecken type scouring machine or a net conveyor type scouring machine, both of tensionless type] or a boiling-in-loop method. It is more preferable to use a continuous scouring machine enabling the treatment of a fabric in open width, because, with the machine, the treatment time is relatively short and no excessive tension is applied to the fabric during the treatment.

Figure 2:
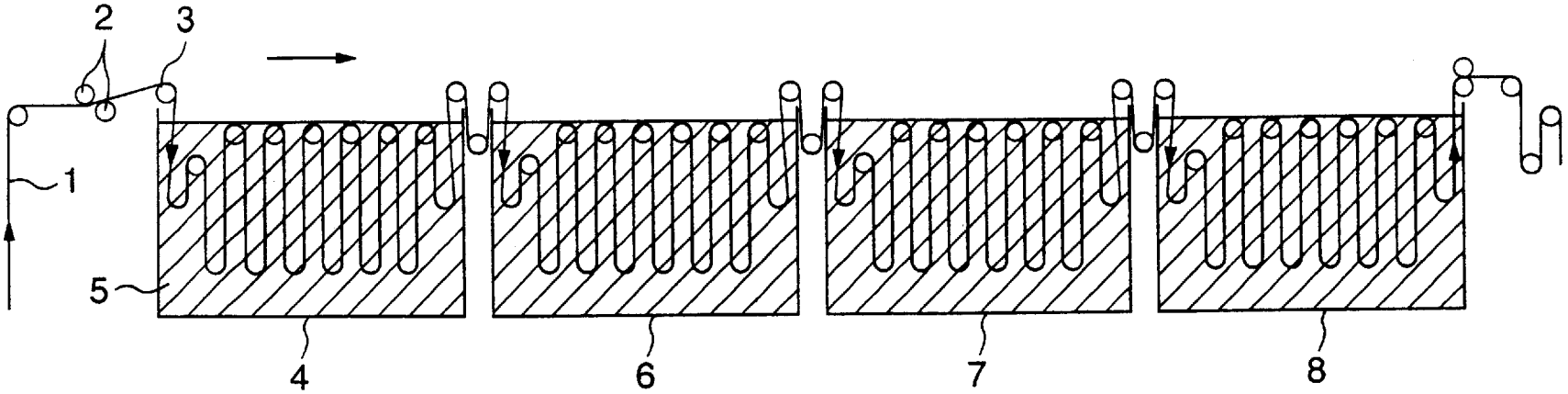
FIG. 2 is a drawing showing a step of subjecting a fabric to an alkali treatment by the use of a scouring machine (tensionless type).

In an example of such a treatment shown in FIG. 2, when a fabric 1 is introduced into an alkali treatment bath 4 of a continuous scouring machine of tensionless type, via a guide roll 2, the fabric 1 becomes in open width since the fabric 1 is suspended by a roller 3 and enters a treating solution 5 and is subjected to an alkali treatment without receiving any excessive tension; thereafter, the fabric 1 is treated in a hot-water-washing bath 6, a neutralization bath 7 and a water-washing bath 8 in this order.

The kind of the fabric to be treated is not particularly restricted and may be any of a woven fabric, a knit fabric and a nonwoven fabric.

(2) A method for treating a yarn with an aqueous alkali solution

The treatment of a yarn with an aqueous alkali solution and subsequent neutralization may be conducted in any stage if it is conducted after spinning and scouring. Such a treatment includes, for example, a continuous treatment, a hank treatment and a cheese treatment, all conducted after spinning and scouring. In the continuous treatment, however, no excessive tension must be applied to a yarn to be treated.

The continuous treatment after spinning and scouring includes, for example, a method which comprises treating a yarn in a bath containing an aqueous alkali solution, then neutralizing the treated yarn in a neutralization bath, passing the resulting yarn through a hot-water-washing bath, and thereafter drying the resulting yarn; and a method which comprises feeding a yarn to be treated, continuously into a net conveyor and spraying the above-mentioned treating solution on the yarn in a shower form.

Figure 3:
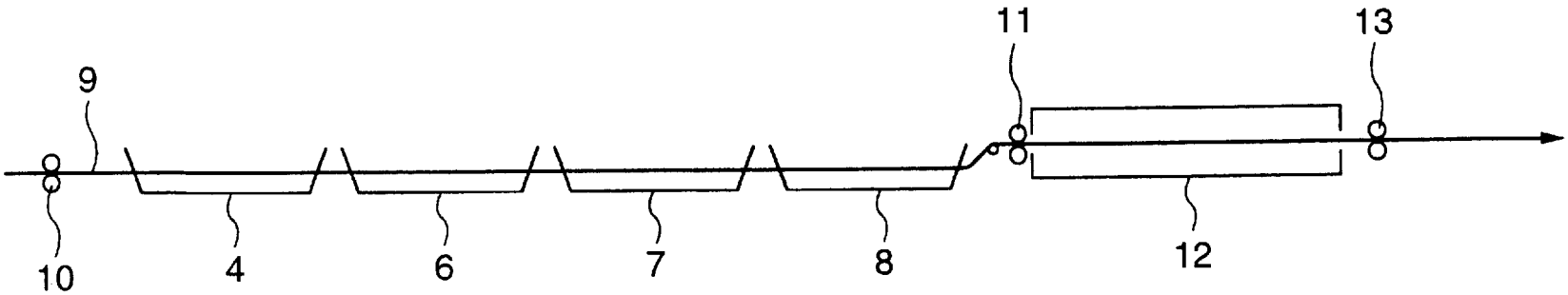
FIG. 3 is a side view showing a step of subjecting a yarn to an alkali treatment.
Figure 4:
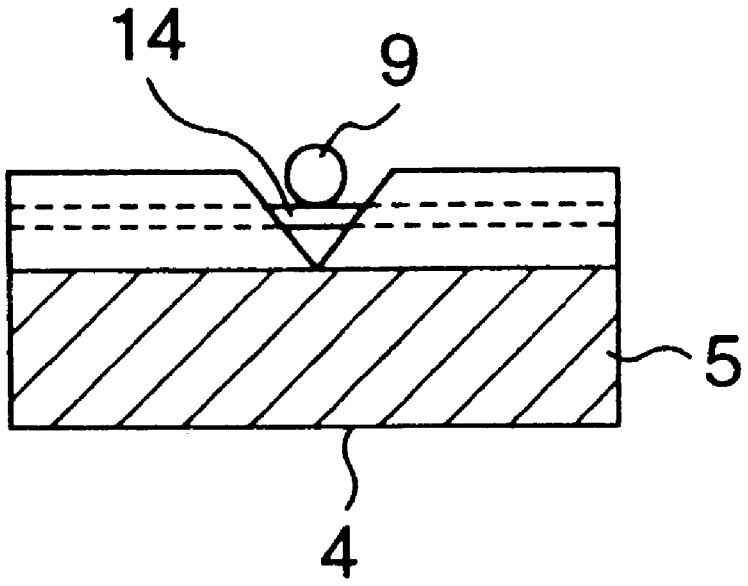
FIG. 4 is a front view showing a state in which a yarn is passed through a treating bath for its alkali treatment.

In an example of such a continuous treatment shown in FIG. 3, a lyocell multifilament yarn 9 is passed through a nip roller 10 and enters an alkali treatment bath 4; then, is passed through a hot-water-washing bath 6, a neutralization bath 7 and a water-washing bath 8 in this order; thereafter, enters a dryer 12 via a nip roller 11, for drying; and is then passed through a nip roller 13. In this case, the speed of the yarn is controlled by the nip rollers 11 and 13 to control the tension applied to the yarn. FIG. 3 is a side view showing this yarn treatment step, and FIG. 4 is a front view of the treating bath 4. As seen from FIG. 4, the yarn 9 is immersed in a treating solution 5 via a guide roll 14; therefore, substantially no tension is applied to the yarn 9 during the treatment.

During the treatment, no excessive tension must be applied to the yarn. The tension applied cannot be strictly specified because it differs depending upon the speed or fineness of yarn, but is generally preferable to be 0.05–0.5 g/d (0.045–0.45 g/dtex) at the outlet of the dryer. When the tension applied is smaller than 0.05 g/d, the yarn does not run stably. When the tension is larger than 0.5 g/d, the resulting yarn has a reduced elongation and no wrinkle improvement is obtained. When the tension is larger than 1 g/d, end breakage occurs.

In the case of hank treatment, use of an injection type hank dyeing machine is preferred. In the case of using a cheese dyeing machine, it is preferable to conduct winding at a winding density of 0.35–0.40 g/cm$^3$, followed by treatment.

The neutralization after the treatment with an aqueous alkali solution is conducted by acid washing until the alkali used is completely removed from the treated yarn or fabric.

The effect of the present invention is maintained even when the yarn or fabric of the present invention is subjected to ordinary dyeing (e.g. dyeing in open width or rope form), resin finish, softening and the like.

The present invention is hereinafter described in more detail by way of Examples. In the followings, the physical properties of each yarn or fabric were measured as follows.

(1) Tenacity and elongation of yarn Measured according to JIS L 1013.

(2) Tenacity and elongation of yarn loosened from fabric

The weft loosened from a fabric was measured for tenacity and elongation both as dried according to JIS L 1013.

(3) Recovery of wrinkles generated in wet state

A fabric sample of 30 cm×30 cm was immersed in water of 20° C. for 5 minutes; then, the sample was dehydrated with a filter paper and folded randomly; and a weight of 1 kg/cm$^2$ was applied to the folded sample. Thereafter, the sample was spread, air-dried, and examined for appearance (i.e. condition of wrinkles). The appearance was expressed in one of 1–5 grades by comparison with a six-ladder three-dimensional replica specified in AATCC Test Method 124-1984. A higher grade indicates less wrinkles. A grade 2.5 or higher was taken as "pass".

(4) Recovery of wrinkles generated in dyeing step

A fabric sample was subjected to ordinary dyeing step by the use of a rotary dyeing machine, and the dyed fabric was examined for appearance. Further, the dyed fabric was subjected to ordinary softening finishing step in open width under no tension and then examined for appearance. The two appearances after the dyeing and finishing steps were each expressed in one of 1–5 grades by comparison with the three-dimensional replica used in the above (3). A higher grade indicates less wrinkles. A grade of 3 or higher was taken as "pass" in the dyed fabric, and a grade of 4 or higher was taken as "pass" in the fabric after finishing.

(5) Wrinkles after laundering of product fabric (W & W property (wash & wear property))

A fabric sample was subjected to laundering in accordance with AATCC Test Method 124. The resulting sample was dried at 60° C. for 30 minutes using a tumbler, then dried for 5 minutes in a cold air, and suspended in a warp direction for at least 2 hours and then examined for appearance. The appearance of the resulting sample was expressed in one of 1–5 grades by comparison with the three-dimensional replica used in the above (3). A higher grade indicates less wrinkles. A grade 2.5 or higher was taken as "pass".

Production of Multifilament Test Yarns 1 and 2

According to the process described in JP-B-60-28848, a pulp and an aqueous N-methylmorpholine N-oxide solution were placed in a mixing tank and mixed under reduced pressure to produce a cellulose solution of 10.0% cellulose concentration. This cellulose solution was subjected to air gap spinning at a discharge temperature of 124° C. under the conditions shown in Table 1. The resulting filaments were water-washed for scouring, dried and wound up to obtain a multifilament test yarn 1 or 2 of 75 d/50 filaments (83 dtex/50 f) having the properties shown in Table 1.

EXAMPLES 1–3 AND COMPARATIVE EXAMPLES 1–3

The multifilament test yarn 1 produced above and shown in Table 1 was subjected to a continuous alkali treatment under the conditions shown in Table 3 and successively to hot water washing (80° C.), neutralization ($CH_3COOH$, pH4), water washing and drying (120° C.), followed by winding up. During this procedure, the pulling speed of yarn was controlled so that the yarn received a tension of 0.1 g/d at the outlet of the drier. The resulting yarn was subjected to plain weave [warp density: 123 yarns/in. (48 yarns/cm), weft density: 85 yarns/in. (33 yarns/cm)] using the yarn as a warp and a weft. Each of the resulting plain weave fabrics was subjected to scouring at 80° C. in a bath containing 1 g/l of $Na_2CO_3$ and 1 ml/l of a surfactant (nonionic type), hot water washing (80° C.), dehydration and drying (120° C.) to obtain fabric samples of Examples 1–3 and Comparative Examples 1–3.

COMPARATIVE EXAMPLE 4

The multifilament test yarn 2 produced above and shown in Table 1 was subjected to a continuous alkali treatment under the conditions of Example 2 shown in Table 3 and successively to hot water washing, neutralization, water washing and drying in the same manner as in Examples 1–3 and Comparative Examples 1–3, followed by winding up. During this procedure, the pulling speed of yarn was controlled so that the yarn received a tension of 0.1 g/d at the outlet of the drier. The resulting yarn was subjected to plain weave [warp density: 123 yarns/-in. (48 yarns/cm), weft density: 85 yarns/in. (33 yarns/cm)] using the yarn as a warp and a weft. Each of the resulting plain weave fabrics was subjected to ordinary scouring and drying to obtain a fabric sample of Comparative Example 4.

EXAMPLES 4–5 AND COMPARATIVE EXAMPLES 5–6

The multifilament test yarns 1 produced above and shown in Table 1 were subjected to a continuous alkali treatment under the conditions of Example 2 shown in Table 3 and successively to hot water washing, neutralization, water washing and drying in the same manner as in Examples 1–3 and Comparative Examples 1–3, followed by winding up. During this procedure, the pulling speed of yarns was controlled so that the yarns received tensions of 0.05, 0.5, 0.7 and 1.1 g/d, respectively, which correspond to Examples 4–5 and Comparative Examples 5–6, respectively, at the outlet of the drier. The resulting yarns were each subjected to plain weave [warp density: 123 yarns/in. (48 yarns/cm), weft density: 85 yarns/in. (33 yarns/cm)] using the yarn as a warp and a weft. Each of the resulting plain weave fabrics was subjected to ordinary scouring and drying to obtain fabric samples of Examples 4–5 and Comparative Examples 5–6.

EXAMPLES 6–8 AND COMPARATIVE EXAMPLES 7–9

The multifilament test yarns 1 produced above and shown in Table 1 were subjected to plain weave [warp density: 123 yarns/in. (48 yarns/cm, weft density: 85 yarns/in. (33 yarns/cm)] using the yarn as a warp and a weft, to obtain plain weave fabrics. The fabrics were subjected to an alkali treatment in open width under the conditions shown in Table 3, by the use of a continuous Hinecken scouring machine (tensionless type) and successively to hot water washing (80° C.), neutralization ($CH_3COOH$, pH4), scouring at 80° C. in a bath containing 1 g/l of $Na_2CO_3$ and 1 ml/l of a surfactant (nonionic type) and drying (120° C.) to obtain fabric samples of Examples 6–8 and Comparative Examples 7–9.

COMPARATIVE EXAMPLE 10

The multifilament test yarn 2 produced above and shown in Table 1 was subjected to plain weave [warp density: 123 yarns/in. (48 yarns/cm, weft density: 85 yarns/in. (33 yarns/cm)] using the yarn as a warp and a weft, to obtain a plain weave fabric. The fabric was subjected to an alkali treatment in open width under the conditions of Example 2 shown in Table 3, by the use of a continuous Hinecken scouring machine (tensionless type) and successively to hot water washing, neutralization, scouring and drying in the same manner as in Examples 6–8 and Comparative Examples 7–9 to obtain a fabric sample of Comparative Example 10.

COMPARATIVE EXAMPLES 11–13

The multifilament test yarn 1 produced above and shown in Table 1 was subjected to plain weave [warp density: 123 yarns/in. (48 yarns/cm, weft density: 85 yarns/in. (33 yarns/cm)] using the yarn as a warp and a weft, to obtain a plain weave fabric. The fabric was subjected to an alkali treatment in a rope form under the conditions shown in Table 3, by the use of a jet dyeing machine and successively to hot water washing, neutralization, scouring and drying in the same manner as in Examples 6–8 and Comparative Examples 7–9 to obtain fabric samples of Comparative Examples 11–13.

COMPARATIVE EXAMPLE 14

The multifilament test yarn 1 produced above and shown in Table 1 was subjected to plain weave [warp density: 123 yarns/in. (48 yarns/cm, weft density: 85 yarns/in. (33 yarns/cm)] using the yarn as a warp and a weft, to obtain a plain weave fabric. The fabric was put in open width under tension by pulling it by 5% in a warp direction and by 5% in a weft direction and, in this condition, subjected to an alkali treatment under the alkaline conditions shown in Table 3; the resulting fabric was subjected to squeezing by the use of a mangle; and the squeezed fabric was subjected, under tension, to hot water washing, neutralization, scouring and drying by the use of a continuous scouring machine of open soaper type, while the other conditions were the same as in Examples 6–8 and Comparative Examples 7–9, to obtain a fabric sample of Comparative Example 11.

EXAMPLES 9–16 AND COMPARATIVE EXAMPLES 15–28

Each of the plain weave fabric samples obtained in Examples 1–8 and Comparative Examples 1–14 was subjected to dyeing under the dyeing conditions shown in Table 2, by the use of a rotary dyeing machine; the dyed fabric was dipped in an aqueous solution containing 10 g/l of a softener (Nicca MS-1F, a methylolamide type softener, a product of Nicca Chemical Co., Ltd.); and the resulting fabric was dried at 130° C. for 2 minutes in a pine tenter dryer to obtain product fabric samples of Examples 9–16 and Comparative Examples 15–28.

The fabric samples and product fabric samples obtained above were measured for physical properties. The results are shown in Table 3 for Examples 1–8 and Comparative Examples 1–14 and in Table 4 for Examples 9–16 and Comparative Examples 15–28.

As is clear from Table 3 and Table 4, the cellulose multifilament yarn of the present invention and the fabric made thereof are favorably balanced in tenacity and elongation of yarn and, as a result, can suppress reduction in tenacity and generation of wrinkles during dyeing and product fabric laundering.

Industrial Applicability

The cellulose multifilament yarn of the present invention and the fabric made thereof suppress reduction in tenacity and generate substantially no wrinkles during dyeing and product fabric laundering and, therefore, are very useful in industry.

TABLE 1

| | Spinning conditions | | | Physical Properties | |
|---|---|---|---|---|---|
| | Nozzle diameter × nozzle number (μm × number) | Linear speed of discharging (m/min) | Draft ratio (times) | Tenacity as dried (g/d) | Elongation as dried (%) |
| Test yarn 1 | 110 × 50 | 60 | 5.5 | 4.0 | 7.5 |
| Test yarn 2 | 50 × 50 | 60 | 1.2 | 2.6 | 13.0 |

TABLE 2

| Dyeing conditions | |
|---|---|
| Dye | Sumifix Navy Blue GS 1% OWF (vinylsulfone type reactive dye) |
| Sodium sulfate | 50 g/l |
| Sodium carbonate | 15 g/l |
| Temperature | 60° C. |
| Bath ratio (weight of bath liquid:weight of fabric) | 15:1 |
| Time | 60 min |

TABLE 3

| | | Conditions of alkali treatment | | | | | Tenacity-elongation curve | | | |
|---|---|---|---|---|---|---|---|---|---|---|
| | | NaOH conc. (g/l) | Temp. (° C.) | Time (sec.) | Breaking tenacity (g/d) | Breaking elongation (%) | Tenacity at 5% elongation (g/d) | Tenacity at 10% elongation (g/d) | Recovery of wrinkles generated in wet state (grade) | Reduction in tenacity |
| Examples | 1 | 55 | 15 | 30 | 3.7 | 14.8 | 0.6 | 2.3 | 3 | No |
| | 2 | 70 | 15 | 30 | 3.5 | 15.0 | 0.3 | 1.9 | 3 | No |
| | 3 | 85 | 15 | 30 | 3.2 | 15.3 | 0.3 | 1.7 | 3 | No |
| | 4 | 70 | 15 | 30 | 3.8 | 15.5 | 0.5 | 2.2 | 3 | No |
| | 5 | 70 | 15 | 30 | 3.4 | 14.9 | 0.3 | 1.8 | 3 | No |
| | 6 | 55 | 15 | 30 | 3.4 | 14.0 | 0.5 | 2.0 | 3 | No |
| | 7 | 70 | 15 | 30 | 3.2 | 14.8 | 0.3 | 1.8 | 3 | No |
| | 8 | 145 | 15 | 30 | 2.9 | 15.8 | 0.2 | 1.0 | 3 | No |
| Comparative Examples | 1 | 0 | 15 | 30 | 3.9 | 11.0 | 1.4 | 3.5 | 1 | No |
| | 2 | 32 | 15 | 30 | 3.7 | 12.5 | 0.8 | 2.9 | 1.5 | No |
| | 3 | 180 | 15 | 30 | 1.8 | 21.2 | 0.1 | 0.7 | 3 | Large |
| | 4 | 70 | 15 | 30 | 1.5 | 15.7 | 0.2 | 0.6 | 3 | Large |
| | 5 | 70 | 15 | 30 | 2.6 | 12.1 | 0.2 | 0.8 | 2.5 | Large |
| | 6 | 70 | 15 | 30 | 1.5 | 10.2 | 0.2 | 0.7 | 2 | End Breakage |
| | 7 | 0 | 15 | 30 | 4.0 | 10.5 | 1.5 | 3.7 | 1 | No |
| | 8 | 32 | 15 | 30 | 3.6 | 11.4 | 1.0 | 2.7 | 1.5 | No |
| | 9 | 180 | 15 | 30 | 1.6 | 16.2 | 0.1 | 0.8 | 3 | Large |
| | 10 | 70 | 15 | 30 | 1.1 | 16.3 | 0.3 | 0.6 | 3 | Large |
| | 11 | 30 | 60 | 240 | 2.8 | 11.5 | 1.1 | 2.0 | 1 | No |
| | 12 | 70 | 60 | 240 | 1.5 | 19.6 | 0.2 | 1.0 | 1 | Large |
| | 13 | 145 | 60 | 240 | 1.2 | 17.7 | 0.1 | 0.5 | 1 | Large |
| | 14 | 161 | 35 | 45 | 2.3 | 9.5 | 1.2 | — | 1 | |

TABLE 4

| | | | | Recovery of wrinkles generated in dyeing step | | Properties of fabric products | | | | | |
|---|---|---|---|---|---|---|---|---|---|---|---|
| | | Conditions of alkali treatment | | After dyeing and drying (grade) | After finishing (grade) | W&W property (grade) | Breaking tenacity (g/d) | Breaking elongation (%) | Tenacity at 5% elongation (g/d) | Tenacity at 10% elongation (g/d) | Condition after laundering |
| Examples | 9 | Examples | 1 | 3 | 5 | 3 | 3.2 | 13.8 | 0.5 | 2.1 | |
| | 10 | | 2 | 3 | 5 | 3 | 3.1 | 14.8 | 0.3 | 1.8 | |
| | 11 | | 3 | 3 | 5 | 3 | 2.8 | 16.0 | 0.3 | 1.7 | |
| | 12 | | 4 | 3 | 5 | 3 | 3.2 | 14.5 | 0.5 | 2.1 | |
| | 13 | | 5 | 3 | 5 | 3 | 3.0 | 14.2 | 0.3 | 1.8 | |
| | 14 | | 6 | 3 | 5 | 3 | 3.4 | 14.0 | 0.4 | 2.0 | |

TABLE 4-continued

| | | Conditions of alkali treatment | Recovery of wrinkles generated in dyeing step: After dyeing and drying (grade) | After finishing (grade) | Properties of fabric products: W&W property (grade) | Breaking tenacity (g/d) | Breaking elongation (%) | Tenacity at 5% elongation (g/d) | Tenacity at 10% elongation (g/d) | Condition after laundering |
|---|---|---|---|---|---|---|---|---|---|---|
| | 15 | 7 | 3 | 5 | 3 | 3.2 | 14.8 | 0.3 | 1.7 | |
| | 16 | 8 | 3 | 5 | 3 | 2.9 | 15.8 | 0.2 | 0.7 | |
| Comparative Examples | 15 | Comparative Examples 1 | 1 | 2 | 1 | 4.1 | 9.1 | 1.3 | 3.6 | |
| | 16 | 2 | 2 | 3 | 1.5 | 3.8 | 11.0 | 0.6 | 2.8 | |
| | 17 | 3 | 3 | 5 | 2.5 | 1.4 | 16.0 | 0.05 | 0.5 | Large damage |
| | 18 | 4 | 3 | 5 | 2.5 | 1.2 | 16.9 | 0.1 | 0.5 | Large damage |
| | 19 | 5 | 2 | 2.5 | 2 | 2.1 | 10.8 | 0.1 | 0.7 | |
| | 20 | 6 | 1.5 | 2 | 1.5 | 1.2 | 9.0 | 0.1 | 0.7 | Large damage |
| | 21 | 7 | 1 | 2 | 1 | 4.0 | 9.5 | 1.3 | 3.5 | |
| | 22 | 8 | 2 | 3 | 1.5 | 3.6 | 11.4 | 0.8 | 2.5 | |
| | 23 | 9 | 3 | 5 | 2.5 | 1.6 | 16.2 | 0.05 | 0.7 | Large damage |
| | 24 | 10 | 3 | 5 | 2.5 | 1.1 | 16.3 | 0.2 | 0.5 | Large damage |
| | 25 | 11 | 1 | 1.5 | 1 | 2.2 | 10.8 | 1.1 | 1.8 | Large damage |
| | 26 | 12 | 1 | 2 | 1 | 1.3 | 17.8 | 0.15 | 0.3 | Large damage |
| | 27 | 13 | 1 | 2 | 1 | 0.8 | 15.6 | 0.05 | 0.2 | Large damage |
| | 28 | 14 | 1.5 | 2 | 1.5 | 2.2 | 9.3 | 1.1 | — | Large damage |

We claim:

1. A cellulose multifilament yarn which is a lyocell multifilament yarn and has a breaking tenacity of 2.8–4.0 g/d (2.5–3.6 g/dtex) and a breaking elongation of 13–20% both as dried and which gives a tenacity-elongation curve passing a tenacity range of 0.2–1.0 g/d (0.18–0.90 g/dtex) at an elongation of 5% and a tenacity range of 0.4–2.5 g/d (0.36–2.3 g/dtex) at an elongation of 10%.

2. A fabric comprising the cellulose multifilament yarn of claim 1.

3. A process for producing the cellulose multifilament yarn of claim 1, which comprises immersing a lyocell multifilament yarn having a breaking tenacity of 3.0–5.0 g/d (2.7–4.5 g/dtex) and a breaking elongation of 5–10% both as dried, in a swelling agent of 50–150 g/l concentration or a solvent both for the yarn under a low tension.

4. A process for producing the fabric of claim 2 comprising the cellulose multifilament yarn, which comprises immersing a fabric comprising a lyocell multifilament yarn having a breaking tenacity of 3.0–5.0 g/d (2.7–4.5 g/dtex) and a breaking elongation of 5–10% both as dried, in a swelling agent of 50–150 g/l concentration or a solvent both for the yarn in open width under a low tension.

5. A process according to claim 3, wherein the swelling agent is selected from the group consisting of sodium hydroxide, potassium hydroxide, sodium carbonate, potassium carbonate and sodium silicate.

6. A process according to claim 4, wherein the swelling agent is selected from the group consisting of sodium hydroxide, potassium hydroxide, sodium carbonate, potassium carbonate and sodium silicate.

* * * * *